US005702012A

United States Patent [19]

Kanjo

[11] Patent Number: 5,702,012

[45] Date of Patent: Dec. 30, 1997

[54] ROTARY DRAWBAR ASSEMBLY FOR A RAILWAY FREIGHT CAR

[75] Inventor: Wajih Kanjo, Lockport, Ill.

[73] Assignee: Westinghouse Air Brake Company, Wilmerding, Pa.

[21] Appl. No.: 653,465

[22] Filed: May 24, 1996

[51] Int. Cl.[6] ..... B61G 5/00

[52] U.S. Cl. ..... 213/62 R; 213/74; 213/75 R

[58] Field of Search ..... 213/74, 75 R, 213/73, 62 R, 12, 21; 105/3

[56] References Cited

U.S. PATENT DOCUMENTS

| | | | |
|---|---|---|---|
| 1,557,060 | 10/1925 | Kadel . | |
| 2,241,353 | 5/1941 | Kinne et al. . | |
| 3,250,403 | 5/1966 | Tack et al. | 213/62 R |
| 3,709,376 | 1/1973 | Altherr | 213/62 R |
| 4,456,133 | 6/1984 | Altherr et al. . | |
| 4,531,648 | 7/1985 | Paton . | |
| 4,555,033 | 11/1985 | Miller . | |
| 4,580,686 | 4/1986 | Elliott . | |
| 4,700,853 | 10/1987 | Altherr et al. . | |
| 4,700,854 | 10/1987 | Chadwick . | |
| 4,846,358 | 7/1989 | Rhen . | |
| 4,946,052 | 8/1990 | Kaim et al. . | |
| 4,966,291 | 10/1990 | Glover | 213/62 R |
| 5,000,330 | 3/1991 | Kaim et al. . | |
| 5,035,338 | 7/1991 | Kaufhold et al. . | |
| 5,520,294 | 5/1996 | Hanes | 213/75 R |
| 5,520,295 | 5/1996 | Wiebe | 213/75 R |
| 5,584,407 | 12/1996 | Kanjo | 213/75 R |

*Primary Examiner*—Mark T. Le
*Attorney, Agent, or Firm*—James Ray & Associates

[57] ABSTRACT

A rotary type slackless drawbar assembly for connecting one end of a first railway freight car to an adjacently disposed end of a second railway freight car in a substantially semi-permanent fashion. Such drawbar assembly includes a rear block member having a substantially flat front face portion which is disposed in a generally vertical direction. A first spherically shaped cavity is formed in a center of the front face portion of such rear block member. A ball-like member has a first portion of an outer surface thereof disposed in such first cavity. An elongated drawbar member is connected at a first end thereof to a radially opposed second portion of such ball-like member. There is a generally U-shaped front block member which includes a substantially flat inner face portion disposed in a generally vertical direction and a second spherically shaped cavity is formed in such flat inner face portion of such front block member. A second portion of an outer surface of the ball-like member located closely adjacent said drawbar member is disposed in such second cavity formed in this inner face portion of such front block member.

17 Claims, 3 Drawing Sheets

ROTARY DRAWBAR ASSEMBLY FOR A RAILWAY FREIGHT CAR

FIELD OF THE INVENTION

The present invention relates, in general, to a slackless type drawbar coupling arrangement-for use in conjunction with a pair of railway type freight cars and, more particularly, this invention relates to an improved slackless drawbar assembly, of the rotary type, for connecting one predetermined end of a first railway freight car to an adjacently disposed end of a second railway freight car in a substantially semi-permanent manner which incorporates therein an absolute minimum number of critical component parts which must move relative to one another during in-track service of such slackless drawbar assembly.

BACKGROUND OF THE INVENTION

Prior to the conception and development of the present invention, as is generally quite well known in the railroad industry, rotary type slackless drawbar assemblies have been and are still being extensively used to connect one end of a first railway freight car to an adjacently disposed end of a second railway freight car. This is particularly the case where such railway type freight cars are in dedicated type service, such as for example only, cars used to transport coal from the mines to the customer.

However, each of the prior art rotary type slackless drawbar assemblies presently being utilized in this application all suffer from at least one common disadvantage. This common disadvantage is that each of these rotary type slackless drawbar assemblies all require the use of a slack take-up device to compensate for the wear of a number of critical component parts which have frictionally engaged surfaces which move relative to one another during in-track service.

It is, also, well known that these frictionally engaged surfaces, of such component parts, will normally experience some rather heavy loads being applied to them even while they are moving relative to one another. These rather heavy loads further add to the frictional wear of these critical component parts. Normally, such slack take-up devices have been wedge members which move in a downwardly direction while the drawbar assembly is in a draft mode, due to gravity, as the wear of such component parts occurs.

Additionally, because of the excessive frictional wear that occurs to a number of these component parts they must be replaced and/or otherwise repaired on a relatively frequent basis in order to ensure that a satisfactory performance of such rotary type slackless drawbar assembly is achieved. Obviously, such frequent repairs and/or replacement of these component parts is costly to the railroad industry not only from the equipment standpoint, but it is also quite costly due to the labor required to make the necessary repairs. Even more importantly, however, during the time period such repairs to the freight car are being performed it obviously must be removed from any type of revenue generating service.

SUMMARY OF THE INVENTION

The present invention provides an improved rotary type slackless drawbar assembly for connecting one predetermined end of a first railway type freight car to an adjacently disposed end of a second railway type freight car in a substantially semi-permanent fashion. Such rotary type slackless drawbar assembly comprising a rear block member having a substantially flat front face portion. At least the substantially flat front face portion of such rear block member is disposed in a generally vertical direction. A first spherically shaped cavity is formed substantially in a center of such substantially flat front face portion of the rear block member. There is a ball-like member having a first portion of an outer surface thereof disposed in this spherically shaped cavity formed in such substantially flat front face portion of the rear block member. An elongated drawbar member is connected at a first end thereof to a radially opposed second portion of such ball-like member. The rotary type slackless drawbar assembly, according to the present invention, further includes a generally U-shaped front block member having a substantially flat inner face portion. At least the substantially flat inner face portion of such generally U-shaped front block member being disposed in a generally vertical direction. Finally, there is a second spherically shaped cavity formed substantially in a center of the substantially flat inner face portion of such front block member. A second portion of an outer surface of the ball-like member located closely adjacent said drawbar member is disposed in this second spherically shaped cavity formed in such substantially flat inner face portion of the front block member.

OBJECTS OF THE INVENTION

It is, therefore, one of the primary objects of the present invention to provide an improved rotary type slackless drawbar assembly for connecting railway type freight cars together in a substantially semi-permanent fashion which has an absolute minimum number of critical component parts that will be required to move relative to one another during in-track service.

Another object of the present invention is to provide an improved rotary type slackless drawbar assembly for connecting railway type freight cars together in a substantially semi-permanent fashion which will require a minimum amount of maintenance.

Still another object of the present invention is to provide an improved rotary type slackless drawbar assembly for connecting railway type freight cars together in a substantially semi-permanent fashion which can be easily and readily retrofitted to existing freight cars.

Yet another object of the present invention is to provide an improved rotary type slackless drawbar assembly for connecting railway type freight cars together in a substantially semi-permanent which is relatively light weight when compared to prior art type rotary slackless drawbar assemblies.

A further object of the present invention is to provide an improved rotary type slackless drawbar assembly for connecting railway type freight cars together in a substantially semi-permanent fashion which is cost effective for the railroad industry when compared to the prior art type rotary slackless drawbar assemblies.

It is an additional object of the present invention to provide an improved rotary type slackless drawbar assembly for connecting railway type freight cars together in a substantially semi-permanent fashion which is relatively easy to install and does not require the use of any special type tools for such installation.

Another object of the present invention to provide an improved rotary type slackless drawbar assembly for connecting railway type freight cars together in a substantially semi-permanent fashion which may be equipped with a lubricating type liner member to significantly reduce the friction that will normally be generated between the frictionally engaged surfaces thereof.

Still yet another object of the present invention to provide an improved rotary type slackless drawbar assembly for connecting railway type freight cars together in a substantially semi-permanent fashion which is generally more reliable than the prior art rotary type slackless drawbar assemblies.

In addition to the several objects and advantages of the present invention which have been described in some detail above, various additional objects and advantages of the improved rotary type slackless drawbar assembly for connecting railway type freight cars together in a substantially semi-permanent fashion will become much more readily apparent to those persons who are skilled in the railway type freight car coupling art from the following more detailed description of the invention, particularly, when such description is taken in conjunction with the attached drawing Figures and with the appended claims.

Figure 1:
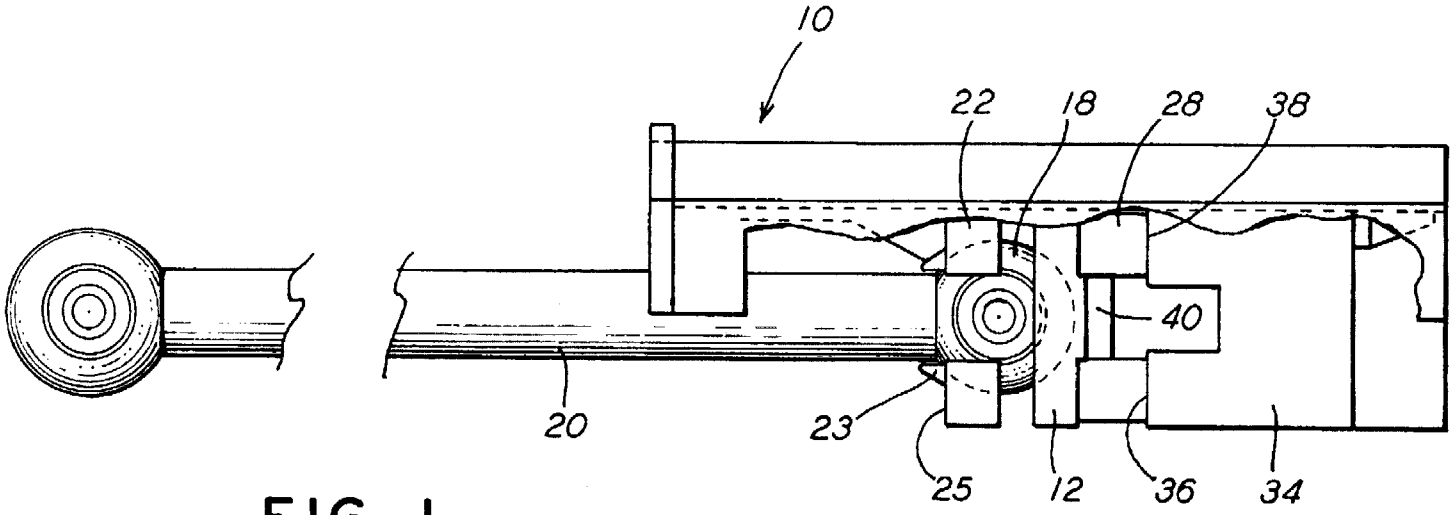
FIG. 1 is a plan view of a presently preferred embodiment of the rotary type slackless drawbar assembly according to the present invention.
Figure 2:
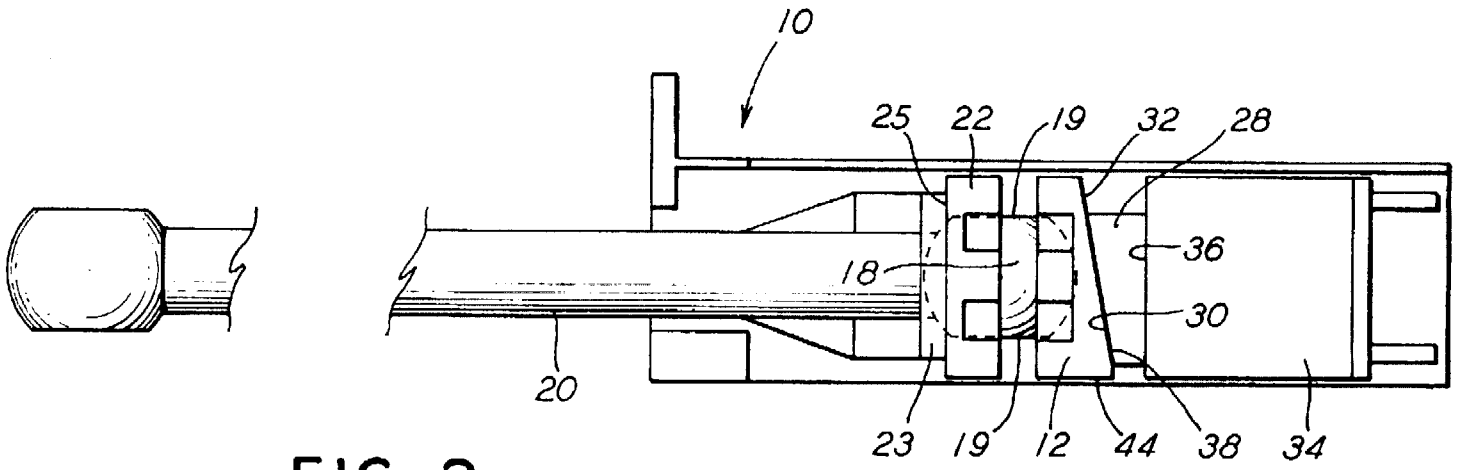
FIG. 2 is a side elevation view of the rotary type slackless drawbar assembly illustrated in FIG. 1.
Figure 3:
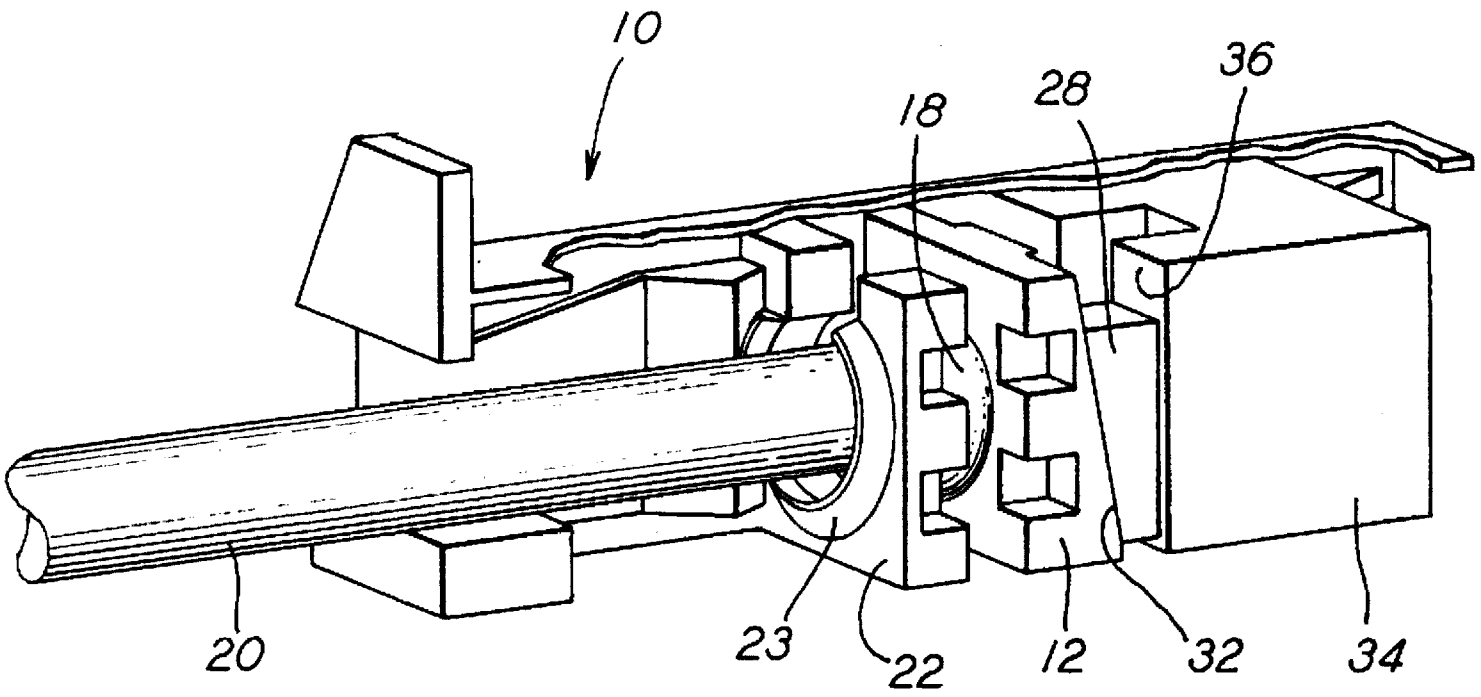
FIG. 3 is a perspective view with certain parts cut away of the rotary type slackless drawbar assembly illustrated in FIG. 1.

BRIEF DESCRIPTION OF A PRESENTLY PREFERRED AND VARIOUS ALTERNATIVE EMBODIMENTS OF THE INVENTION

Prior to proceeding to the more detailed description of the present invention, it should be noted that, for the sake of clarity and understanding of the invention, identical components having identical functions have been identified with identical reference numerals throughout the several views which have been illustrated in the drawings.

Now reference is made, more particularly, to FIGS. 1 through 5. Illustrated therein is a presently preferred embodiment of the rotary type slackless drawbar assembly, generally designated 10, and produced according to the present invention. Such rotary type slackless drawbar assembly 10 connects one predetermined end (not shown) of a first railway type freight car (not shown) to an adjacently disposed end (not shown) of a second railway type freight car (not shown) in a substantially semi-permanent fashion.

The improved rotary type slackless drawbar assembly 10, according to the invention, includes a rear block member 12 which has a substantially flat front face portion 14. At least the substantially flat front face portion 14 of such rear block member 12 will, preferably, be disposed in a generally vertical direction. As can best be seen in FIG. 4, there is a first spherically shaped cavity 16 that is formed substantially in a center of the substantially flat front face portion 14 of such rear block member 12.

According to the present invention, there is a ball-like member 18 provided. This ball-like member 18 has a first portion of an outer surface thereof disposed in such first spherically shaped cavity 16 formed in such substantially flat front face portion 14 of the rear block member 12. Additionally, there is an elongated drawbar member 20 provided which is connected at a first end thereof to a radially opposed second portion of such ball-like member 18.

Figure 5:
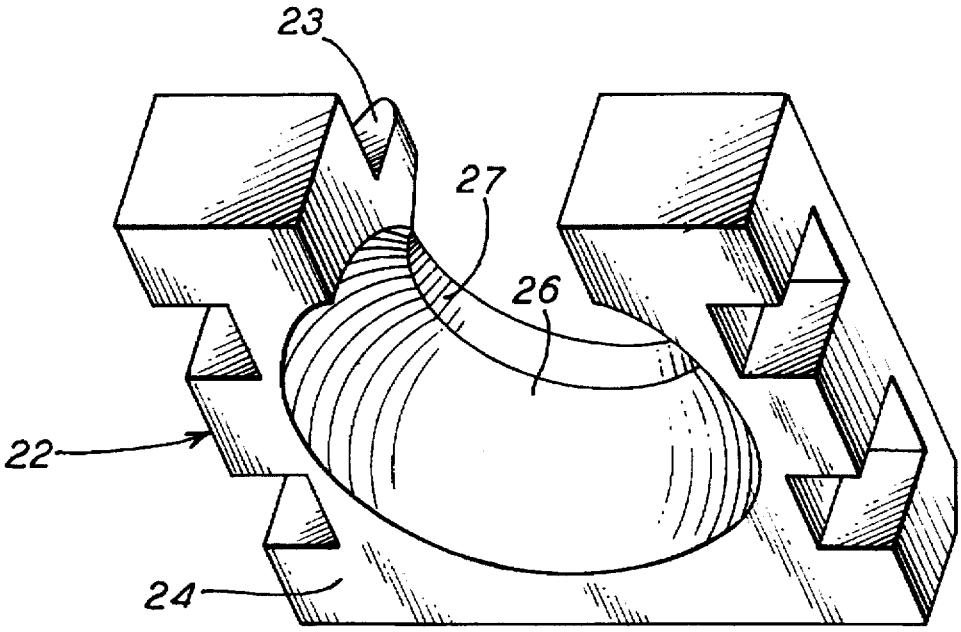
FIG. 5 is a perspective view of a presently preferred front block member for use with the rotary type slackless drawbar assembly according to the present invention.

As can best be seen in FIG. 5, the rotary type slackless drawbar assembly 10 further includes a generally U-shaped front block member 22. Like the rear block member 12, such generally U-shaped front block member 22 has a substantially flat inner face portion 24. At least this substantially flat inner face portion 24 of such generally U-shaped front block member 22 is disposed in a generally vertical direction. In addition, there is a second spherically shaped cavity 26 formed substantially in the center of such substantially flat inner face portion 24 of such generally U-shaped front block member 22.

Such generally U-shaped front block member 22, preferably, has a substantially rectangular shape and includes a generally round ring-like portion 23. This generally round ring-like portion 23 extends outwardly from an outer face portion 25 of such generally U-shaped front block member 22. This generally round ring-like portion 23 is disposed substantially radially opposite such second spherically shaped cavity 26 formed in such substantially flat inner face portion 24 of the generally U-shaped front block member 22. This generally round ring-like portion 23 includes a tapered surface portion 27 adjacent an inner portion thereof to enable the required angling movement of the drawbar member 20.

A second portion of an outer surface of such ball-like member 18, located closely adjacent the drawbar member 20, is disposed in such second spherically shaped cavity 26 formed in the substantially flat inner face portion 24 of the generally U-shaped front block member 22.

Preferably, such ball-like member 18 is formed as an integral single piece unit with such elongated drawbar member 20. Such ball-like member 18, also, preferably, includes a pair of substantially flat surface portions 19 formed on radially opposed sides thereof.

In the rotary type slackless drawbar assembly 10, according to the presently preferred embodiment of the invention, such first spherically shaped cavity 16 formed in the rear block member 12 will have a radius of curvature which is substantially identical to a radius of curvature of the second spherically shaped cavity 26 formed in such generally U-shaped front block member 22. Preferably, such radius of curvature of the first spherically shaped cavity 16 and the radius of curvature of such second spherically shaped cavity 26 will be slightly larger than a radius of curvature of such ball-like member 18.

In addition, in this presently preferred embodiment of the invention, such slackless drawbar assembly 10 will further include a first lubricating liner member (not shown) disposed between the first spherically shaped cavity 16 formed in such front face portion 14 of the rear block member 12 and such first portion of the outer surface of such ball-like member 18 and a second lubricating liner member (not shown) disposed between the second spherically shaped cavity 26 formed in such inner face portion 24 of the generally U-shaped front block member 22 and such second portion of such outer surface of such ball-like member 18.

In the presently preferred embodiment of the rotary type slackless drawbar assembly 10, such drawbar assembly 10 will further include at least one substantially vertically disposed wedge-like member 28. A front surface 30 of such at least one wedge-like member 28 is engaged with at least a portion of a back surface 32 of such rear block member 12.

Additionally, if such slackless drawbar assembly 10 is being retrofitted to a railway freight car having a draft gear pocket, then such slackless drawbar assembly 10 will further include a filler block member 34. This filler block member 34 has a front surface 36 thereof which engages with a rear surface 38 of such at least one vertically disposed wedge-like member 28.

Figure 4:
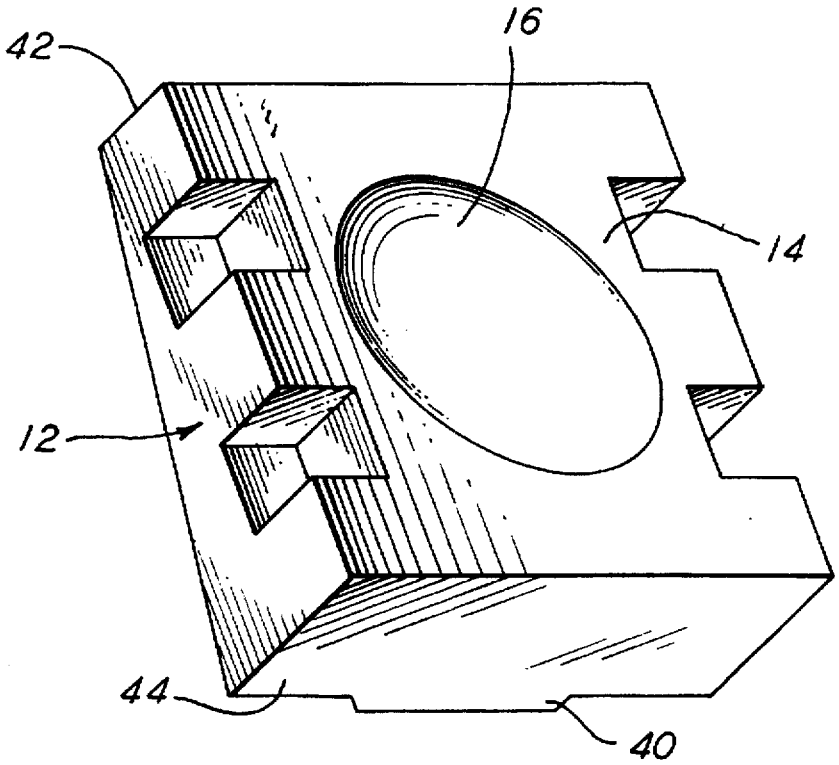
FIG. 4 is a perspective view of a presently preferred rear block member for use with the rotary type slackless drawbar assembly according to the present invention.

As is clearly illustrated in FIGS. 1 and 4, such rear block member 12 includes a substantially vertically disposed and centrally located rib-like member 40. This rib-like member 40 extends outwardly for a predetermined distance from such back surface 32 of the rear block member 12. Also, such rib-like member 40, preferably, extends from an upper surface 42 to the bottom surface 44 of such rear block member 12.

In the presently preferred embodiment of such rotary type slackless drawbar assembly 10, such drawbar assembly 10 further includes a pair of vertically disposed wedge-like members 28 which have a front surface 30 thereof engaged with at least a respective outer edge portion of the back surface 32 of such rear block member 12. In FIG. 1 it is clearly illustrated that the back surface 32 of such rear block member 12 is tapered downwardly from an upper portion 42 of such rear block member 12 and outwardly towards the bottom portion 44 of such rear block member 12.

Prior to proceeding further with the detailed description of the drawing Figures, it should be understood and noted here that the second axially opposed end of such slackless drawbar assembly could be equipped with a non-rotary type coupling arrangement and still be within the spirit of the invention and the scope of the appended claims.

Nevertheless, the rotary type slackless drawbar assembly 10, according to the presently preferred embodiment of the invention, further includes a second rear block member (not shown, but which would be substantially identical to the rear block member 12). Such second rear block member has a substantially flat front face portion like the rear block member 12. Furthermore, at least this substantially flat front face portion of such second rear block member would also be disposed in a generally vertical direction.

A third spherically shaped cavity (not shown) is formed substantially in a center of such substantially flat front face portion of such second rear block member.

There is a second ball-like member (not shown) which has a first portion of an outer surface thereof disposed in such third spherically shaped cavity formed in the substantially flat front face portion of such second rear block member and connected to a second axially opposed end of such elongated drawbar member 20 at a radially opposed second portion of such second ball-like member.

Additionally, there is a second generally U-shaped front block member (not shown, but which would be substantially identical to the generally U-shaped front block member 22) which also has a substantially flat inner face portion. At least this substantially flat inner face portion of such second generally U-shaped front block member is disposed in a generally vertical direction and a fourth spherically shaped cavity (not shown) is formed substantially in a center of such substantially flat inner face portion of the second front block member. A second portion of an outer surface of such second ball-like member located closely adjacent such drawbar member 20 is disposed in such fourth spherically shaped cavity formed in such substantially flat inner face portion of such second front block member.

In the rotary type slackless drawbar assembly 10, according to the presently preferred embodiment of the invention, the ball-like member 18 and the second ball-like member are formed as an integral single piece unit with such elongated drawbar member 20 and each of such ball-like member 18 and such second ball-like member will include a pair of substantially flat surface portions formed on radially opposed sides thereof.

Furthermore, a radius of curvature of each of such first spherically shaped cavity 16, such second spherically shaped cavity 26, such third spherically shaped cavity and such fourth spherically shaped cavity will, preferably, be substantially identical.

It is further preferred that such radius of curvature of such first spherically shaped cavity 16 and such radius of curvature of such second spherically shaped cavity 26 are slightly larger than a radius of curvature of such ball-like member 18 and that the radius of curvature of such third spherically shaped cavity and such fourth spherically shaped cavity are slightly larger than a radius of curvature of such second ball-like member. Additionally, the radius of curvature of such ball-like member 18 and the radius of curvature of such second ball-like member will, preferably, be substantially identical. This means, of course that the radius of curvature of such first, second, third and fourth spherically shaped cavities will also be substantially identical.

In addition to the first and second lubricating liner members which were discussed above, in the presently preferred embodiment of the invention, when each end of the slackless drawbar assembly is equipped for rotary movement such rotary type slackless drawbar assembly 10 will further include a third lubricating liner member (not shown) disposed between such third spherically shaped cavity formed in the front face portion of such second rear block member and the first portion of such outer surface of the second ball-like member and a fourth lubricating liner member (not shown) disposed between such fourth spherically shaped cavity formed in the front face portion of such second generally U-shaped front block member and the second portion of the outer surface of such second ball-like member.

Although a presently preferred and a number of various alternative embodiments of the instant invention have been described in some detail above, various additional adaptations and/or other modifications of the improved rotary type slackless drawbar assembly can be made by persons who are skilled in the art and, particularly, the railway freight car type coupling art without departing from either the spirit of the invention or the scope of the appended claims.

I claim:

1. A rotary slackless drawbar assembly for connecting one predetermined end of a first railway freight car to an adjacently disposed end of a second railway freight car in a substantially semi-permanent fashion, said rotary slackless drawbar assembly comprising:

(a) a rear block member having a substantially flat front face portion, at least said substantially flat front face portion of said rear block member being disposed in a generally vertical direction, said rear block member has a substantially rectangular shape and includes a substantially vertically disposed and centrally located rib-like member extending outwardly from said back surface thereof;

(b) a first spherically shaped cavity formed substantially in a center of said substantially flat front face portion of said rear block member, said first spherically shaped cavity having a predetermined radius of curvature;

(c) a ball-like member having a first portion of an outer surface thereof disposed in said first spherically shaped cavity formed in said substantially flat front face portion of said rear block member, said first portion of said outer surface of said ball-like member having a predetermined radius of curvature;

(d) an elongated drawbar member connected at a first end thereof to a portion of said ball-like member disposed radially opposite said first portion of said ball-like member;

(e) a generally U-shaped front block member having a substantially flat inner face portion, at least said substantially flat inner face portion of said generally U-shaped front block member being disposed in a generally vertical direction; and (f) a second spherically shaped cavity formed substantially in a center of said substantially flat inner face portion of said front block member, a second portion of an outer surface of said ball-like member located closely adjacent said elongated drawbar member being disposed in said second spherically shaped cavity formed in said substantially flat inner face portion of said front block member, each of said second spherically shaped cavity and said second portion of said outer surface of said ball-like member have a predetermined radius of curvature.

2. A rotary slackless drawbar assembly, according to claim 1, wherein said slackless drawbar assembly further includes:

(i) a second rear block member having a substantially flat front face portion, at least said substantially flat front face portion of said second rear block member being disposed in a generally vertical direction;

(ii) a third spherically shaped cavity formed substantially in a center of said substantially flat front face portion of said second rear block member, said third spherically shaped cavity having a predetermined radius of curvature;

(iii) a second ball-like member having a first portion of an outer surface thereof disposed in said third spherically shaped cavity formed in said substantially flat front face portion of said second rear block member and connected to a second axially opposed end of said elongated drawbar member at a radially opposed second portion of said second ball-like member, said first portion of said outer surface of said second ball-like member having a predetermined radius of curvature;

(iv) a second generally U-shaped front block member having a substantially flat inner face portion, at least said substantially flat inner face portion of said second generally U-shaped front block member being disposed in a generally vertical direction; and (v) a fourth spherically shaped cavity formed substantially in a center of said substantially flat inner face portion of said second front block member, a second portion of an outer surface of said second ball-like member located closely adjacent said drawbar member being disposed in said fourth spherically shaped cavity formed in said substantially flat inner face portion of said second front block member, each of said fourth spherically shaped cavity and said second portion of said second ball-like member have a predetermined radius of curvature.

3. A rotary slackless drawbar assembly, according to claim 1, wherein said slackless drawbar assembly further includes at least one vertically disposed wedge-like member having a front surface thereof engaged with at least a portion of a back surface of said rear block member.

4. A rotary slackless drawbar assembly, according to claim 3, wherein said slackless drawbar assembly further includes a filler block member having a front surface thereof engaged with a rear surface of said at least one vertically disposed wedge-like member.

5. A rotary slackless drawbar assembly, according to claim 1, wherein said slackless drawbar assembly further includes a pair of vertically disposed wedge-like members each having a front surface thereof engaged with a back surface of said rear block member adjacent at least a respective outer edge portion thereof.

6. A rotary slackless drawbar assembly, according to claim 5, wherein said back surface of said rear block member is tapered downwardly from an upper surface portion of said rear block member and outwardly towards a bottom surface portion of said rear block member.

7. A rotary slackless drawbar assembly, according to claim 1, wherein said ball-like member is formed as an integral single piece unit with said elongated drawbar member.

8. A rotary slackless drawbar assembly, according to claim 7, wherein said ball-like member includes a pair of substantially flat surface portions formed on radially opposed sides thereof.

9. A rotary slackless drawbar assembly, according to claim 2, wherein said ball-like member and said second ball-like member are formed as an integral single piece unit with said elongated drawbar member.

10. A rotary slackless drawbar assembly, according to claim 9, wherein each of said ball-like member and said second ball-like member includes a pair of substantially flat surface portions formed, respectively, on radially opposed sides thereof.

11. A rotary slackless drawbar assembly, according to claim 1, wherein said generally U-shaped front block member has a substantially rectangular shape and includes a generally round ring-like portion extending outwardly from an outer face portion thereof, said generally round ring-like portion being disposed substantially radially opposite said second spherically shaped cavity formed in said substantially flat inner face portion of said generally U-shaped front block member.

12. A rotary slackless drawbar assembly, according to claim 11, wherein said generally round ring-like portion includes a tapered surface portion disposed adjacent an inner portion thereof to enable all necessary angling movements of said elongated drawbar member during in-track service of said slackless drawbar assembly.

13. A rotary slackless drawbar assembly, according to claim 1, wherein said radius of curvature of said first spherically shaped cavity formed in said rear block member is substantially identical to said radius of curvature of said second spherically shaped cavity formed in said front block member.

14. A rotary type slackless drawbar assembly, according to claim 13, wherein said radius of curvature of said first spherically shaped cavity and said radius of curvature of said second spherically shaped cavity are slightly larger than said radius of curvature of said ball-like member.

15. A rotary slackless drawbar assembly, according to claim 2, wherein said radius of curvature of each of said first spherically shaped cavity, said second spherically shaped cavity, said third spherically shaped cavity and said fourth spherically shaped cavity are substantially identical.

16. A rotary slackless drawbar assembly, according to claim 15, wherein said radius of curvature of said first spherically shaped cavity and said radius of curvature of said second spherically shaped cavity are slightly larger than a radius of curvature of said ball-like member and said radius of curvature of said third spherically shaped cavity and said fourth spherically shaped cavity are slightly larger than a radius of curvature of said second ball-like member.

17. A rotary slackless drawbar assembly, according to claim 16, wherein said radius of curvature of said ball-like member and said radius of curvature of said second ball-like member are substantially identical.

* * * * *